US007878763B2

(12) United States Patent
Keith et al.

(10) Patent No.: US 7,878,763 B2
(45) Date of Patent: Feb. 1, 2011

(54) TURBINE ROTOR BLADE ASSEMBLY AND METHOD OF ASSEMBLING THE SAME

(75) Inventors: Sean Robert Keith, Fairfield, OH (US); Michael Joseph Danowski, Cincinnati, OH (US); Leslie Eugene Leeke, Jr., Burlington, KY (US)

(73) Assignee: General Electric Company, Schenectady, NY (US)

( * ) Notice: Subject to any disclaimer, the term of this patent is extended or adjusted under 35 U.S.C. 154(b) by 917 days.

(21) Appl. No.: 11/748,529

(22) Filed: May 15, 2007

(65) Prior Publication Data

US 2008/0286106 A1 Nov. 20, 2008

(51) Int. Cl.
*F01D 5/30* (2006.01)

(52) U.S. Cl. ..... 416/193 A; 416/248

(58) Field of Classification Search ..... 416/193 A, 416/193 R, 248

See application file for complete search history.

(56) References Cited

U.S. PATENT DOCUMENTS 3,801,222 A 4/1974 Violette
4,019,832 A 4/1977 Salemme et al.
4,483,661 A 11/1984 Manharth
5,193,982 A 3/1993 Inizan et al.
5,222,865 A 6/1993 Corsmeier
5,281,096 A 1/1994 Harris et al.
2004/0258528 A1 * 12/2004 Goga et al. ..... 416/193 A

* cited by examiner

*Primary Examiner*—Edward Look
*Assistant Examiner*—Dwayne J White
(74) *Attorney, Agent, or Firm*—William Scott Andes, Esq.; Armstrong Teasdale LLP

(57) ABSTRACT

A removable rotor blade platform includes a first platform leg, a second platform leg, and a platform portion coupled to the first and second platform legs. The first platform leg is configured to be retained by a first retainer coupled to a first rotor blade, and the second platform leg is configured to be retained by a second retainer coupled to a second adjacent rotor blade. A method of assembling a blade assembly that includes a removable platform, a rotor assembly including the removable platform, and a gas turbine engine assembly including the removable platform, are also described herein.

21 Claims, 6 Drawing Sheets

TURBINE ROTOR BLADE ASSEMBLY AND METHOD OF ASSEMBLING THE SAME

BACKGROUND OF THE INVENTION

The field of the present invention relates generally to gas turbine engines and, more particularly, to turbine engine rotor blades and a method of assembling a turbine rotor blade assembly.

FIG. 1 is a perspective view of a pair of known rotor blades that each include an airfoil 2, a platform 4, and a shank or dovetail 6. During fabrication, the known rotor blades are cast such that the platform is formed integrally with the airfoil and the shank. More specifically, the airfoil, the platform, and the shank are cast as a single unitary component.

During operation, because the airfoil is exposed to higher temperatures than the dovetail, temperature gradients may develop at the interface between the airfoil and the platform, and/or between the shank and the platform. Over time, thermal strain generated by such temperature gradients may induce compressive thermal stresses to the platform. Accordingly, the increased operating temperature of the platform may cause platform oxidation, platform cracking, and/or platform creep deflection, which may shorten the useful life of the rotor blade.

To facilitate reducing the effects of the high temperatures in the platform region, shank cavity air and/or a mixture of blade cooling air and shank cavity air is introduced into a region below the platform region using cooling passages to facilitate cooling the platform. However, the cooling passages may introduce a thermal gradient into the platform which may cause compressed stresses to occur on the upper surface of the platform region. Moreover, because the platform cooling holes are not accessible to each region of the platform, the cooling air may not be uniformly directed to all regions of the platform.

Since the platform is formed integrally with the dovetail and the shank, any damage that occurs to the platform generally results in the entire rotor blade being discarded, thus increasing the overall maintenance costs of the gas turbine engine.

BRIEF SUMMARY OF THE INVENTION

In one aspect, a method of assembling a blade assembly is provided. The method includes providing a first rotor blade having a shank portion and an airfoil that is formed integrally with the shank portion, providing a second rotor blade having a shank portion and an airfoil that is formed integrally with the shank portion, and coupling a platform between the first and second rotor blades.

In another aspect, a rotor blade platform is provided. The rotor blade platform includes a first platform leg, a second platform leg, and a platform portion coupled to the first and second platform legs, the first platform leg configured to be retained by a first retainer coupled to a first rotor blade, and the second platform leg configured to be retained by a second retainer coupled to a second adjacent rotor blade.

In a further aspect, a rotor assembly is provided. The rotor assembly includes a rotor disk, a first rotor blade coupled to the rotor disk, a second rotor blade coupled to the rotor disk, and a rotor blade platform removably coupled between the first and second rotor blades.

In still a further aspect, a gas turbine engine assembly is provided. The gas turbine engine assembly includes a rotor, and a plurality of circumferentially-spaced rotor blades coupled to the rotor, each rotor blade comprising a dovetail and a shank coupled to the dovetail, and a rotor blade platform removably coupled between at least two of the rotor blades.

DETAILED DESCRIPTION OF THE INVENTION

Figure 2:
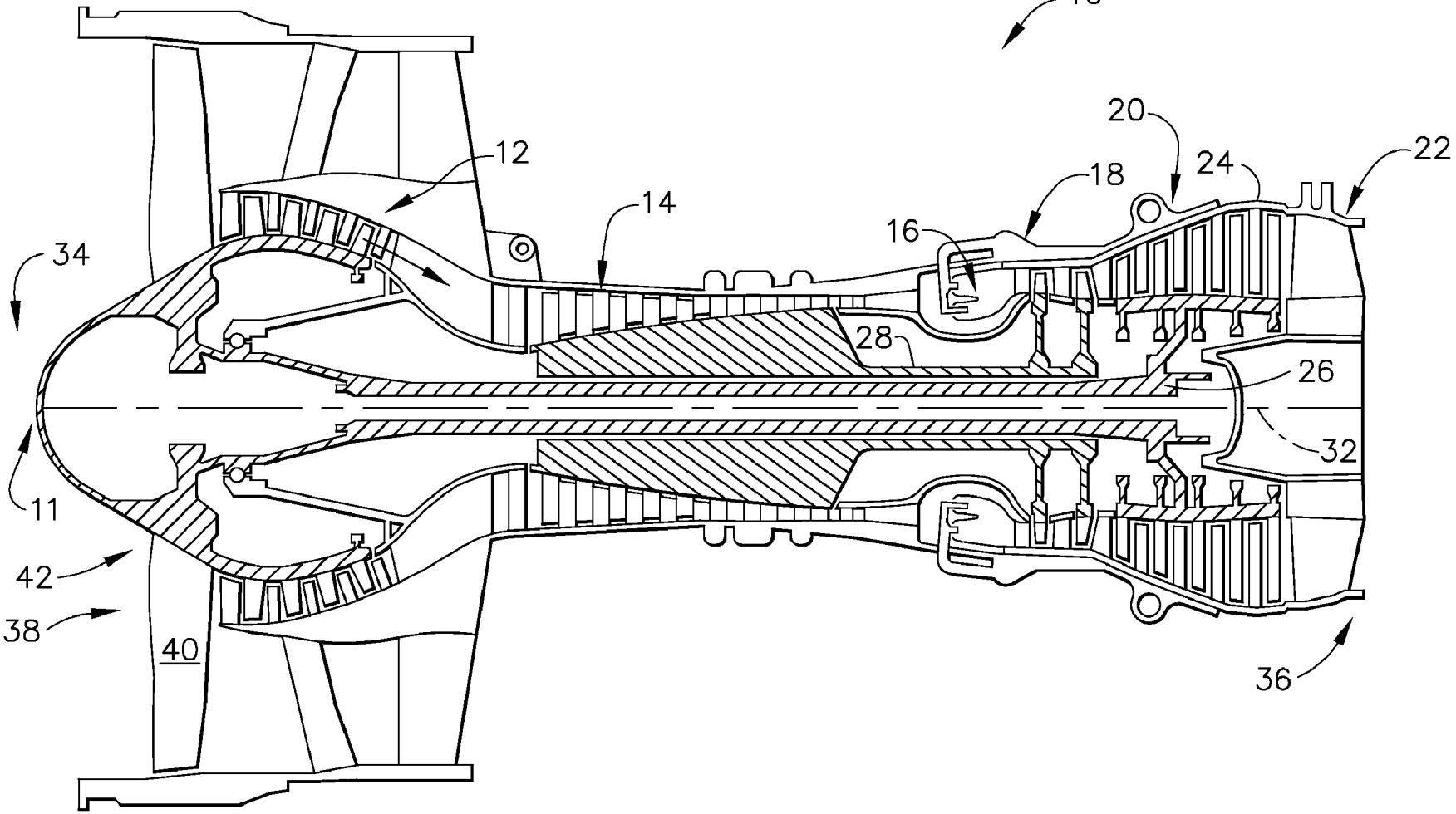
FIG. 2 is a schematic illustration of an exemplary gas turbine engine.

FIG. 2 is a schematic illustration of an exemplary gas turbine engine 10 that includes a fan assembly 11, a low-pressure compressor 12, a high-pressure compressor 14, and a combustor 16. Engine 10 also includes a high-pressure turbine (HPT) 18, a low-pressure turbine 20, an exhaust frame 22 and a casing 24. A first shaft 26 couples low-pressure compressor 12 to low-pressure turbine 20, and a second shaft 28 couples high-pressure compressor 14 to high-pressure turbine 18. Engine 10 has an axis of symmetry 32 extending from an upstream end 34 of engine 10 aft to a downstream end 36 of engine 10. Fan assembly 11 includes a fan 38, which includes at least one row of airfoil-shaped fan blades 40 attached to a hub member or disk 42.

In operation, air flows through low-pressure compressor 12 and compressed air is supplied to high-pressure compressor 14. Highly compressed air is delivered to combustor 16. Combustion gases from combustor 16 propel turbines 18 and 20. High pressure turbine 18 rotates second shaft 28 and high pressure compressor 14, while low pressure turbine 20 rotates first shaft 26 and low pressure compressor 12 about axis 32.

Figure 1:
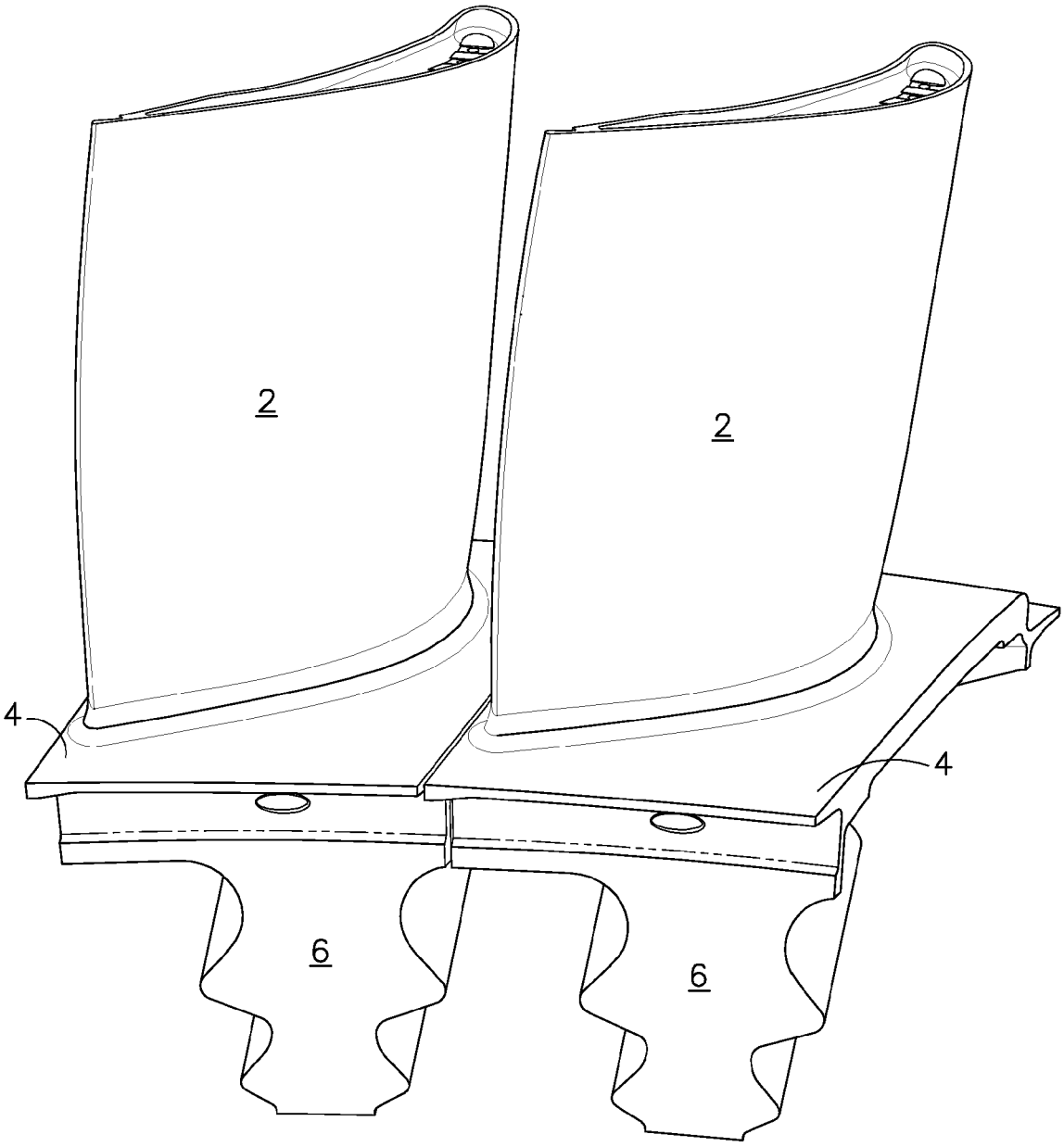
FIG. 1 (PRIOR ART)
FIG. 1 is a perspective view of a pair of known rotor blades.
Figure 3:
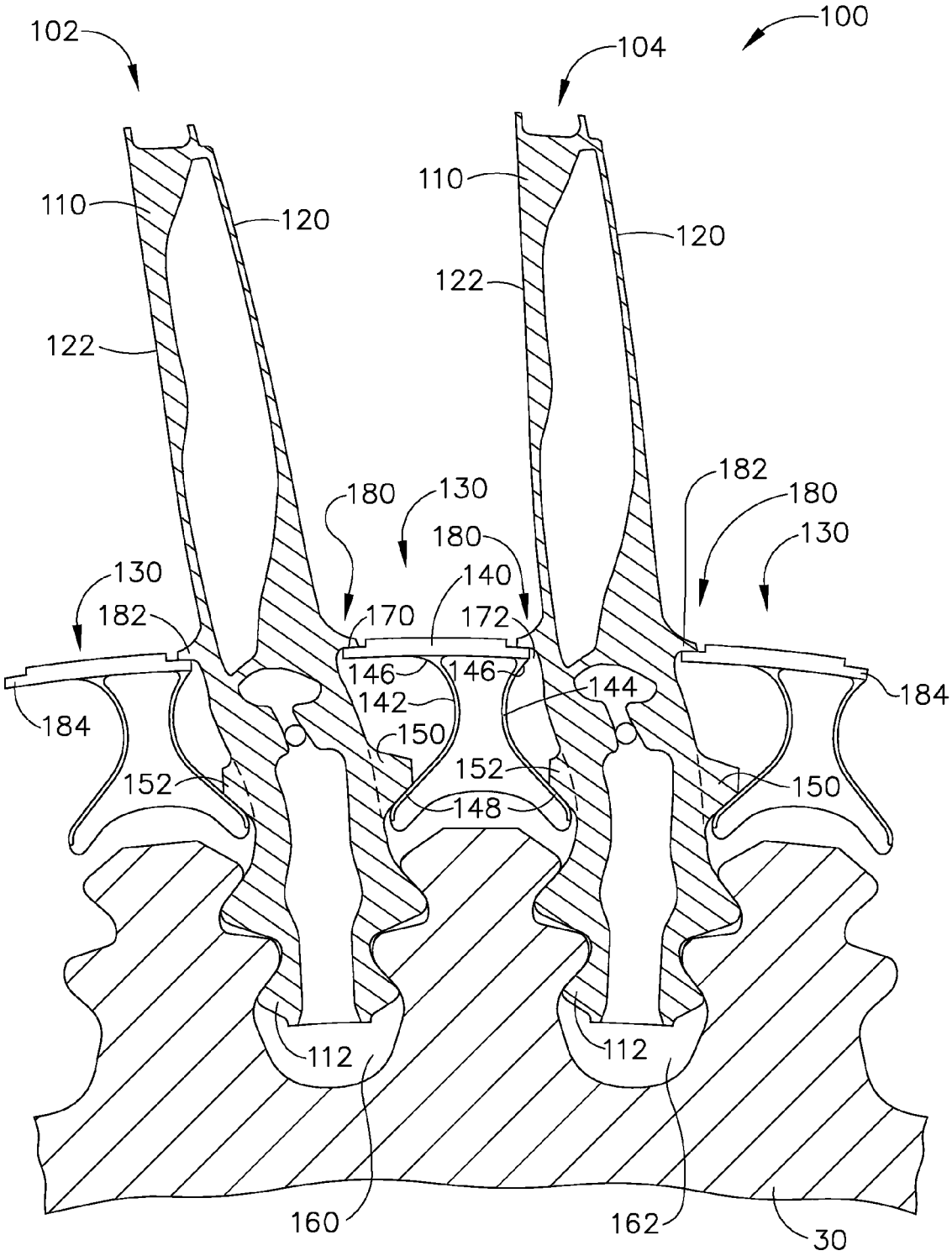
FIG. 3 is an enlarged perspective view of a pair of exemplary rotor blades that may be used with the gas turbine engine shown in FIG. 2.
Figure 4:
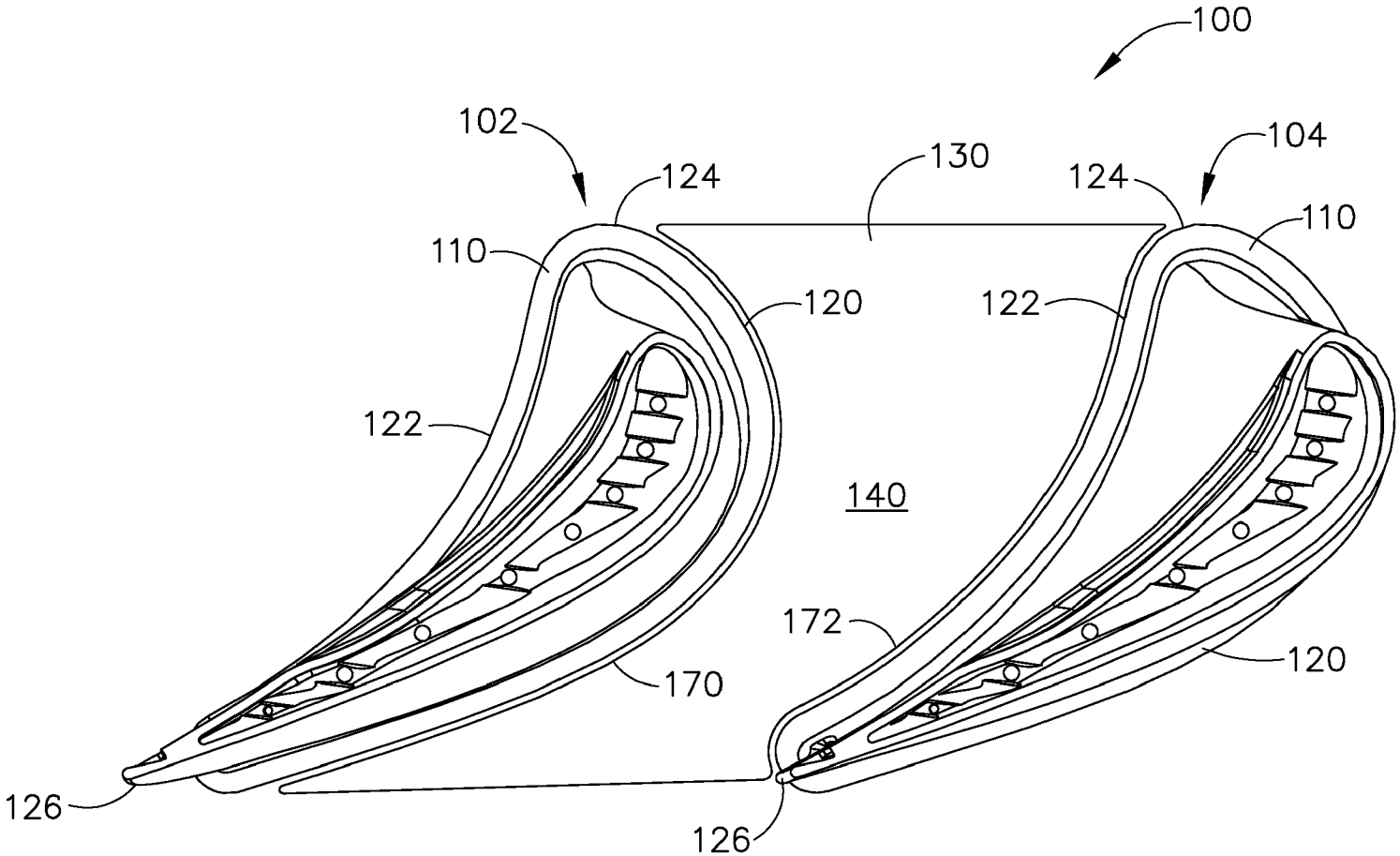
FIG. 4 is a top view of the exemplary rotor blades shown in FIG. 3.
Figure 5:
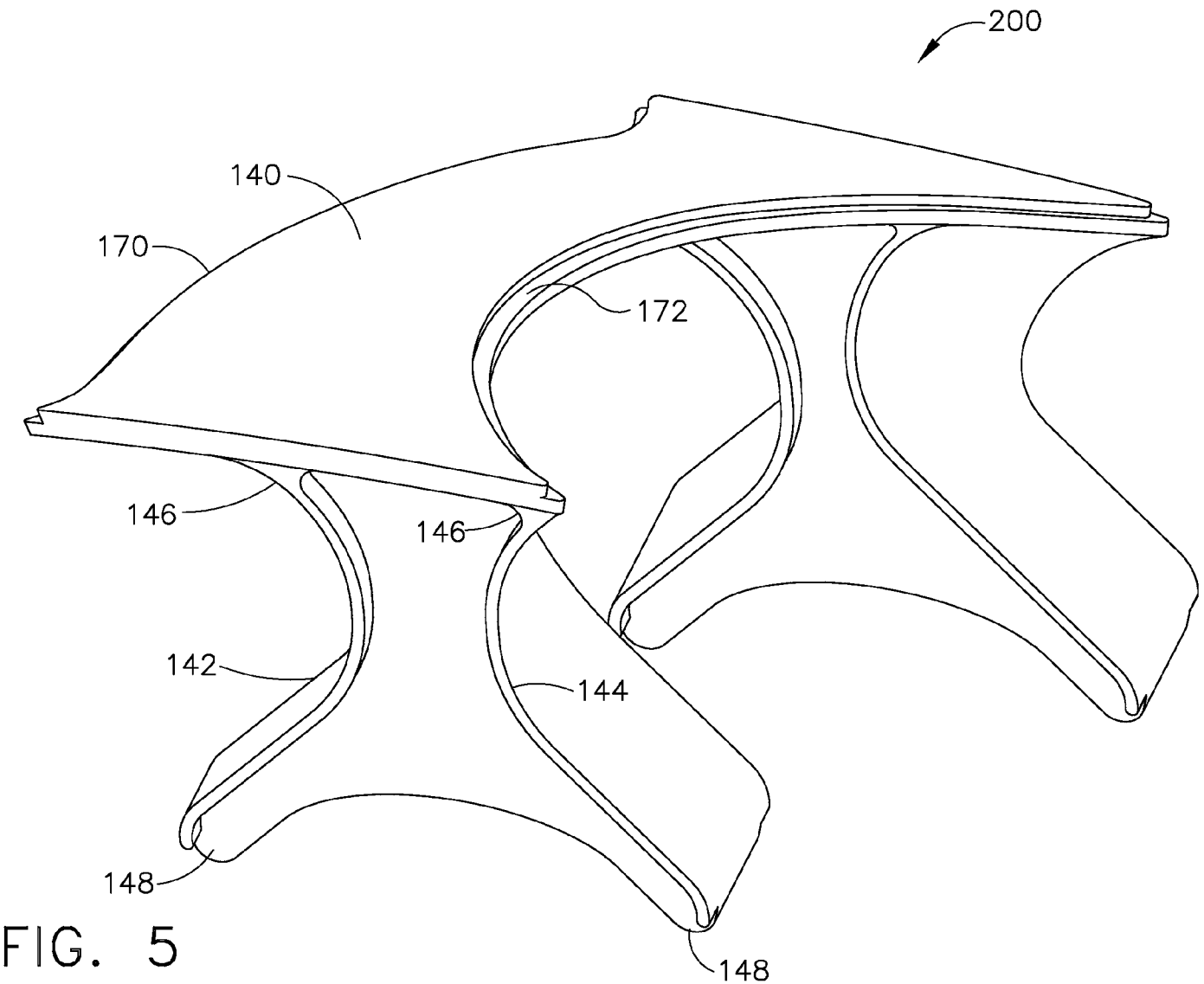
FIG. 5 is a perspective view on the exemplary platform shown in FIGS. 3 and 4.

FIG. 3 is an enlarged perspective view of an exemplary blade assembly 100. FIG. 4 is a top view of blade assembly 100. FIG. 5 is a top view of the exemplary platform shown in FIGS. 3 and 4. Blade assembly 100 includes at least a first rotor blade 102 and a second rotor blade 104 that is coupled adjacent to first rotor blade 102 each of which may be used with the exemplary gas turbine engine 10 (shown in FIG. 1). In the exemplary embodiment, each of blades 102 and 104 has been modified to include the features described herein. When coupled within the rotor assembly, each rotor blade 102 and 104 is coupled to a rotor disk, such as high-pressure turbine rotor disk 30 (shown in FIG. 1), that is rotatably coupled to a rotor shaft, such as shaft 28, for example. In an alternative embodiment, blades 102 and 104 are mounted within a rotor spool (not shown). In the exemplary embodiment, adjacent rotor blades 102 and 104 are identical and each extends radially outward from rotor disk 30. Each rotor blade 102 and 104 includes an airfoil 110 and a shank or dovetail 112 that is formed unitarily with airfoil 110.

Each airfoil 110 includes a first sidewall 120 and a second sidewall 122. First sidewall 120 is convex and defines a suction side of airfoil 110, and second sidewall 122 is concave and defines a pressure side of airfoil 110. Sidewalls 120 and 122 are joined together at a leading edge 124 and at an axially-spaced trailing edge 126 of airfoil 110. As shown in FIG. 4, airfoil trailing edge 126 is spaced chord-wise and downstream from airfoil leading edge 124.

Blade assembly 100 also includes a removable platform 130 that is disposed between first and second rotor blades 102 and 104. More specifically, as discussed above, known rotor blades each include a platform that substantially circumscribes the rotor blade and is formed or cast as a unitary part of the airfoil and the shank. However, in this exemplary embodiment, rotor blades 102 and 104 do not include a platform that is formed unitarily with the airfoil 110. Rather, as illustrated, blade assembly 100 includes removable platform 130 that is disposed between rotor blades 102 and 104 and facilitates maintaining a proper distance between rotor blades 102 and 104. Removable, as described herein is defined as a component that is not permanently attached to the rotor blades by either casting the platform unitarily with the airfoil and shank, or using a welding or brazing procedure for example, to attach the platform the airfoil and shank. Rather the component, i.e. removable platform 130, is friction fit between the rotor blades or mechanically attached to the rotor blades to enable removable platform 130 to be removed from the blade assembly 100 without removing, damaging, modifying, or changing the structural integrity of either rotor blades 102 and/or 104.

In the exemplary embodiment, removable platform 130 includes a platform portion 140, a first platform leg 142, and a second platform leg 144. The platform legs generally have a substantially C-shaped cross-sectional profile. Each platform leg 142 and 144 includes a first end 146 that is coupled to platform portion 140, and a second end 148 that is utilized to secure removable platform 130 between rotor blades 102 and 104. In the exemplary embodiment, first and second platform legs 142 and 144 are formed unitarily with platform portion 140. Moreover, in one embodiment, removable platform 130 is fabricated from the same metallic material used to fabricate rotor blades 102 and 104. Optionally, removable platform 130 may be fabricated using a material that is different than the material used to fabricate rotor blades 102 and 104.

As shown in FIGS. 3, 4, and 5, platform portion 140 has a first edge 170 that is disposed proximate to sidewall 120 of first rotor blade 102. As such, first edge 170 has a profile that substantially mirrors the profile of first sidewall 120. As used herein, the term "mirrors," or variations thereof, refers to a profile that substantially matches, corresponds to, conforms to, and/or is a complement of another profile. For example, since first sidewall 120 has a convex profile, platform first edge 170 is fabricated to have a concave profile. Moreover, platform portion 140 has a second edge 172 that is disposed proximate to sidewall 122 of second rotor blade 104. As such, second edge 172 has a profile that substantially mirrors the profile of second sidewall 122. For example, since second sidewall 122 has a concave profile, second edge 172 is fabricated to have a substantially convex profile.

As shown in FIG. 3, each of rotor blades 102 and 104 include a first platform retainer 150 and a second platform retainer 152. In the exemplary embodiment, platform retainers 150 and 152 are formed unitarily with rotor blades 102 and 104. Optionally, platform retainers 150 and 152 may be coupled to a respective rotor blade using a welding or brazing procedure, for example.

In use, platform retainers 150 and 152 are configured to cooperate with removable platform 130 to retain removable platform 130 between rotor blades 102 and 104. Platform retainers 150 and 152 are generally implemented as tabs or protrusions that extend from the sidewalls of each rotor blade 102 and 104. For example, rotor blades 102 and 104 each include first platform retainer 150 that is mounted on the first sidewall 120 and second platform retainer 152 that is on the second sidewall 122. As shown in FIG. 3, the first platform retainer 150 is included on first rotor blade 102 and the second platform retainer 152 which is provided on second rotor blade 104 are utilized to support removable platform 130. Generally, the first platform retainer 150 is provided on a first rotor blade and the second platform retainer 152 is provided on a second adjacent rotor blade to support the removable platform 130 between the adjacent rotor blades. For each pair of adjacent rotor blades, a pair of adjacent retainers 150 are 152 are provided.

Figure 6:
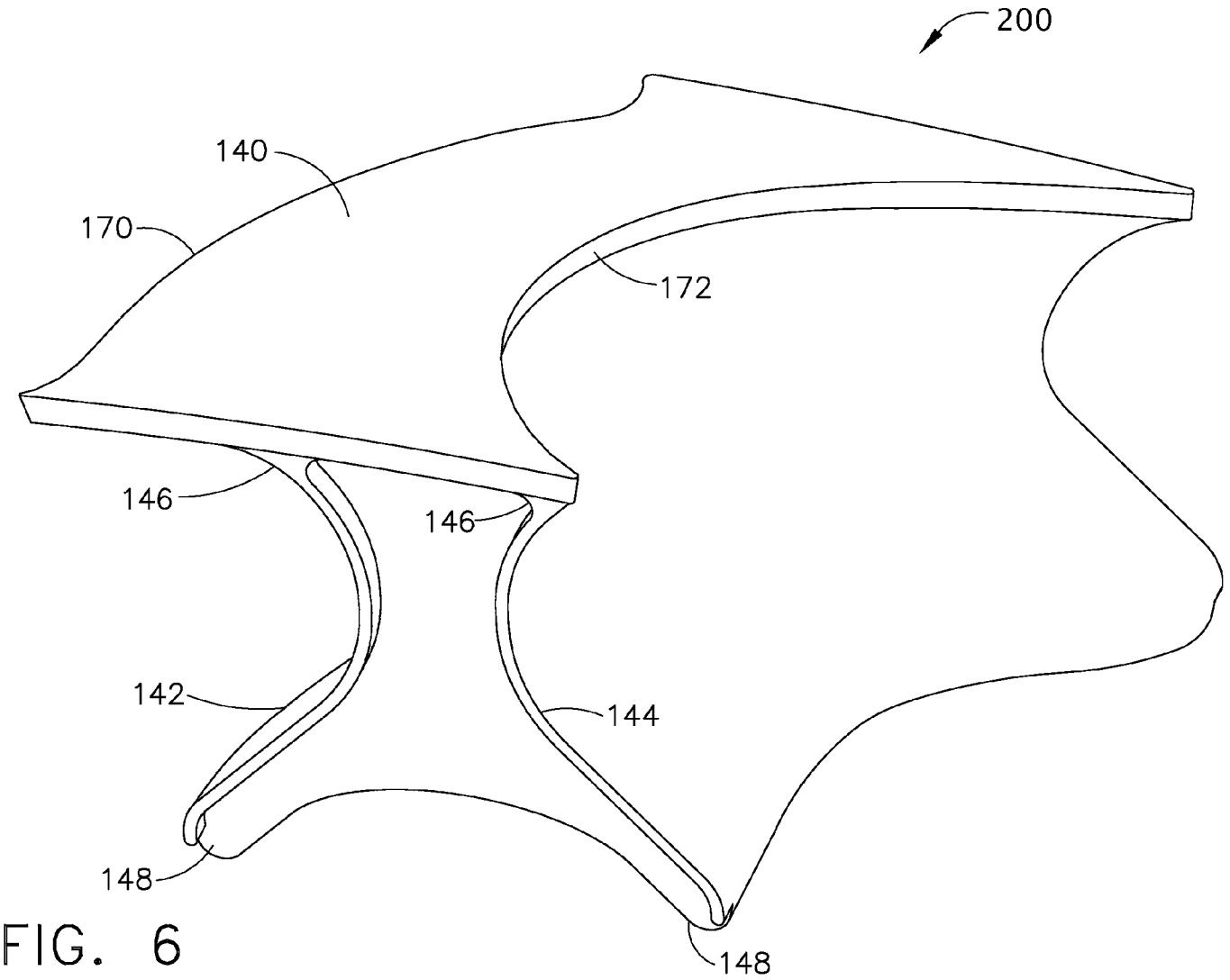
FIG. 6 is a perspective view of another exemplary platform that may be utilized with the rotor blades shown in FIG. 3.

Moreover, as shown in FIG. 3, to facilitate sealing the blade and to substantially prevent airflow from being channeled through the blade, the removable platform 130 includes a pair of lap joints 180 that each include an edge or lap 182 that is formed or cast as part of each rotor blade 110 and 112 and an edge or lap 184 that is formed or cast as part of removable platform 130. As such, the lap joint 180 facilitates sealing blade 110 and 112 from airflow passing through the rotor disk. In another exemplary embodiment, shown in FIG. 6, sealing of rotor blades 110 and 112 is accomplished using a removable platform 200. Removable platform 200 is substantially similar to removable platform 130, however in this embodiment, first platform leg 142 and second platform leg 144 each have a length that is substantially similar to the width or a respective rotor blade 110 and 112. More specifically, as shown in FIG. 3, in this embodiment, platform retainers 150 and 152 extend along the length of each respective rotor blade 110 and 112, and the first and second platform legs 142 and 144 have a length that is substantially the same as the length of the platform retainers 150 and 152, thus increasing the surface or sealing area between the platform retainers and the removable platform 200. In this embodiment, removable platform 200 may also include the lap joint 180 shown in FIG. 2. Optionally, removable platform 200 does not include lap joint 180.

To assemble assembly 100, first rotor blade 102 is cast or fabricated to include the shank portion 112 and dovetail 110 formed integrally with the shank portion. Moreover, the second rotor blade 104 is cast or fabricated to include the shank portion 112 and the airfoil 110 that is formed integrally with the shank portion 112. As discussed above, the removable platform 130 is fabricated as a separate component. The removable platform is then coupled between the first and second rotor blades 102 and 104, respectively.

For example, to assemble an exemplary turbine rotor, such as rotor 30, includes providing the first rotor blade 102 and installing the first rotor blade 102 in a first disk slot 160. The method also includes providing the second rotor blade 104, and installing the second rotor blade 104 in an adjacent disk slot 162. As shown in FIG. 3, slots 160 and 162 are machined or cast to include a profile that is substantially similar to the profile of shanks 112 to enable each respective rotor blade to be retained within each respective slot. Removable platform 130 is then coupled between the adjacent rotor blades and retained between the respective rotor blades using the platform retainers as discussed above.

During engine operation, removable platform 130 is configured to be moveable between rotor blades 102 and 104. Moreover, since a distance between platform leg second ends 148 is greater than a distance between platform retainers 150 and 152, centrifugal motion of the rotor assembly causes removable platform 130 to move in a radially outward direction until the platform leg second ends 148 contact platform retainers 150 and 152, thus causing removable platform 130 to be maintained in a substantially fixed position during engine operation.

Described herein is a new approach to platform design. The platform described is fabricated separately and is assembled between two adjacent blades. The platform may be assembled from the same material as the blade or from any other suitable material, including less costly materials and/or lighter materials. The platform is carried by the blade lugs located on the shank. The platform may also be configured as a damper or may be configured to carry a damper.

As a result, the platform is free to expand and contract under engine operating thermal conditions, resulting in an elimination of platform and airfoil fillet distress. Specifically, the platform is free to expand and contract under engine operating thermal conditions, resulting in reduced platform stresses, and allowing for the use of less costly or lighter materials, or materials that have special temperature capability without strength requirements. The platform is a separate piece and is replaceable, disposable at overhaul, resulting in reduced scrap and maintenance cost, and facilitates cored platform cooling options.

Exemplary embodiments of rotor blades and rotor assemblies are described above in detail. The rotor blades are not limited to the specific embodiments described herein, but rather, components of each rotor blade may be utilized independently and separately from other components described herein. For example, the removable platforms described herein may be utilized on a wide variety of rotor blades, and is not limited to practice with only rotor blades 102 and 104 as described herein. Rather, the present invention can be implemented and utilized in connection with many other blade configurations. For example, the methods and apparatus can be equally applied to stator vanes or rotor blades utilized in steam turbines for example.

While the invention has been described in terms of various specific embodiments, those skilled in the art will recognize that the invention can be practiced with modification within the spirit and scope of the claims.

What is claimed is:

1. A method of assembling a blade assembly, said method comprising:

providing a first rotor blade having a shank portion and an airfoil formed integrally with the shank portion;

providing a second rotor blade having a shank portion and an airfoil that is formed integrally with the shank portion; and coupling a platform between the first and second rotor blades using a lap joint configured to seal a space between the removable platform and said rotor blade.

2. The method in accordance with claim 1, wherein providing a first and second rotor blade further comprises providing a first rotor blade having a first platform retainer, providing a second rotor blade having a second platform retainer, and coupling the platform between the first and second rotor blades such that the first and second platform retainers facilitate securing the platform between the first and second rotor blades.

3. The method in accordance with claim 2, further comprising fabricating the platform to include a platform portion, a first platform leg, and a second platform leg.

4. The method in accordance with claim 3, further comprising coupling the platform between the first and second rotor blades such that the first platform leg is retained by the first platform retainer and such that the second platform leg is retained by the second platform retainer.

5. A platform for a rotor blade, comprising:

a first platform leg;

a second platform leg; and a platform portion coupled to said first and second platform legs, said platform portion including a lap joint configured to seal a space between the platform portion and said rotor blade said first platform leg secured to said platform portion by a first retainer coupled to a first rotor blade, and said second platform leg secured to said platform portion by a second retainer coupled to a second rotor blade.

6. The rotor blade platform in accordance with claim 5, wherein said platform portion comprises:

a first edge having a profile that substantially mirrors a profile of said first rotor blade; and a second edge having a profile that substantially mirrors a profile of said second rotor blade.

7. The rotor blade platform in accordance with claim 5, wherein said first and second platform legs are formed unitarily with said platform portion.

8. The rotor blade platform in accordance with claim 5, wherein said first and second platform legs each comprises a first end that is coupled to said platform portion and a second end, said second ends separated by a first distance, said first and second retainers separated by a second distance that is less than the first distance.

9. The rotor blade platform in accordance with claim 5, wherein said first and second rotor blades each comprises a first metallic material, and said first platform leg, said second platform leg, and said platform portion each comprises the metallic material.

10. A rotor assembly, comprising:

a rotor disk;

a first rotor blade coupled to said rotor disk;

a second rotor blade coupled to said rotor disk; and a rotor blade platform removably coupled between said first and second rotor blades said removable platform including a lap joint configured to seal a space between the platform portion and said first and second rotor blades.

11. The rotor assembly in accordance with claim 10, wherein said first rotor blade comprises a first platform retainer coupled to a first side of said first rotor blade, and said second rotor blade comprises a second platform retainer coupled to a second side of said second rotor blade.

12. The rotor assembly in accordance with claim 11, wherein said rotor blade platform comprises:

a first platform leg;

a second platform leg; and a platform portion coupled to said first and second platform legs, said first platform leg configured to be retained by said first platform retainer and said second platform leg configured to be retained by a second platform retainer.

13. The rotor assembly in accordance with claim 12, wherein said platform portion comprises:

a first edge having a profile that substantially mirrors a profile of said first rotor blade first side; and a second edge having a profile that substantially mirrors a profile of said second rotor blade second side.

14. The rotor assembly in accordance with claim 12, wherein said first and second platform legs are formed unitarily with said platform portion.

15. The rotor assembly in accordance with claim 12, wherein said first and second platform legs each further comprise:

a first end that is coupled to said platform portion; and a second end, said first and second ends separated by a first distance, said first and second retainers separated by a second distance that is less than the first distance.

16. A gas turbine engine rotor assembly, comprising:

a rotor; and a plurality of circumferentially-spaced rotor blades coupled to said rotor, each said rotor blade comprising a dovetail and a shank coupled to said dovetail;

a rotor blade platform removably coupled between at least two of said rotor blades; and a lap joint configured to seal a space between the removable platform and said rotor blades.

17. The gas turbine engine assembly in accordance with claim 16, wherein said plurality of rotor blades comprise at least a first rotor blade and a second rotor blade that is disposed adjacent to said first rotor blade, said first rotor blade comprises a first platform retainer coupled to a first side of said first rotor blade, and said second rotor blade comprises a second platform retainer coupled to an second side of said second rotor blade.

18. The gas turbine engine assembly in accordance with claim 17, wherein said rotor blade platform comprises:

a first platform leg;

a second platform leg; and a platform portion coupled to said first and second platform legs, said first platform leg configured to be retained by said first platform retainer and said second platform leg configured to be retained by a second platform retainer.

19. The gas turbine engine assembly in accordance with claim 18, wherein said platform portion comprises:

a first edge having a profile that substantially mirrors a profile of said first rotor blade first side; and a second edge having a profile that substantially mirrors a profile of said second rotor blade second side.

20. The gas turbine engine assembly in accordance with claim 19, wherein said first and second platform legs each further comprise:

a first end that is coupled to said platform portion; and a second end, said second ends separated by a first distance, said first and second retainers separated by a second distance that is less than the first distance.

21. The gas turbine engine assembly in accordance with claim 18 wherein said first platform leg and said second platform leg have a length that is approximately equal to a length defined between the blade leading edge and the blade trailing edge, said first and second retainers have a length that is substantially similar to the length of said first and second platform legs to facilitate sealing said rotor blade.

* * * * *